US005948245A

United States Patent [19]

Hodak

[11] Patent Number: 5,948,245

[45] Date of Patent: Sep. 7, 1999

[54] FLOW DIVERTING WEIR FOR A SWIMMING POOL SKIMMER

[76] Inventor: Michael L. Hodak, 326 Double Tree Dr., Venetia, Pa. 15367

[21] Appl. No.: 08/823,408

[22] Filed: Apr. 8, 1997

Related U.S. Application Data

[60] Provisional application No. 60/015,059, Apr. 9, 1996.

[51] Int. Cl.[6] ..... E04H 4/16

[52] U.S. Cl. ..... 210/169; 210/232; 4/496

[58] Field of Search ..... 210/169, 776, 210/232, 459; 4/490, 507, 496

[56] References Cited

U.S. PATENT DOCUMENTS

| | | | |
|---|---|---|---|
| 4,379,749 | 4/1983 | Roth | 210/169 |
| 4,789,470 | 12/1988 | Wards | 210/169 |
| 5,059,314 | 10/1991 | Beckman | 210/169 |
| 5,285,538 | 2/1994 | Hodak | 4/507 |
| 5,392,472 | 2/1995 | Maxfield | 4/512 |
| 5,490,923 | 2/1996 | Penney | 210/242.1 |

*Primary Examiner*—Jay H. Woo
*Assistant Examiner*—Fred Prince
*Attorney, Agent, or Firm*—Webb, Ziesenheim, Logsdon, Orkin & Hanson, P.C.

[57] ABSTRACT

A skimmer for a swimming pool includes a weir which extends outwardly from the skimmer face plate to divert a portion of the flowing pool water into the skimmer for subsequent treatment and recirculation. The weir is preferably attached to the skimmer face plate by a flexible lip formed around a peripheral edge of the weir which selectively snaps onto and off of a flange formed around the perimeter of the skimmer face plate. The leading edge of the weir extends outwardly from the pool sidewall to exert an enlarged field of influence on the water flowing along the surface of the pool to skim debris from the pool in less time than conventional skimmer devices.

3 Claims, 5 Drawing Sheets

FLOW DIVERTING WEIR FOR A SWIMMING POOL SKIMMER

CROSS REFERENCE TO RELATED APPLICATION

This application claims the benefit of United States Provisional Application Serial No. 60/015,059, filed on Apr. 9, 1996.

Be it known that I: MICHAEL L. HODAK, citizen of the UNITED STATES OF AMERICA and residing at 326 Double Tree Drive, Venetia, Pa., 15367, have invented certain new and useful improvements in a FLOW DIVERTING WEIR FOR A SWIMMING POOL SKIMMER of which the following is a specification.

BACKGROUND OF THE INVENTION

The present invention relates generally to swimming pool accessories and, more particularly, to skimmers. Swimming pools commonly have one or more skimmers placed in the sidewall thereof at water level to permit the removal of floating debris and other contaminants from the surface of the pool. The skimmer conventionally has a strainer basket within its body to collect larger objects, such as leaves, insects, and the like, while the balance of the water passes through the strainer and is sent to a pump/filtration unit by appropriate piping where the finer contaminants are removed. The filtered water is then returned to the pool in a conventional manner. Periodic additions of chemicals are made, such as chlorine, to maintain proper pH and biological levels in the pool water.

The opening in a conventional skimmer is substantially co-planar with the pool sidewall and draws surface water into the skimmer body, mainly as a function of the power of the pump motor. In order to increase the efficiency of surface cleaning and to remove floating objects and contaminants which tend to accumulate around the pool wall perimeter, it is common practice to direct the inlet water nozzles in an angular direction relative to the sidewall to create either a clockwise or counterclockwise water flow current around the pool. This type of flow pattern tends to sweep debris from the pool sidewalls and minimizes the debris accumulation problem.

Unfortunately, when a clockwise or counterclockwise flow pattern is created in the pool, the conventional, planar skimmer opening is capable of capturing only the debris floating immediately adjacent to the sidewall. The debris beyond this capture zone usually floats past the skimmer opening and must make one or more additional circuits around the pool prior to being captured by the skimmer. Debris floating in the central area of the pool generally will not reach the skimmer for a considerable amount of time.

My invention solves this problem by providing a skimmer attachment which increases the ability of the skimmer to capture debris traveling past the skimmer at distances far greater than heretofore thought possible. The improved skimmer of the invention thus captures floating debris efficiently to clean the entire surface of the swimming pool more quickly than conventional skimmers. The improved skimmer of the present invention is also reversible, making it possible to handle water flow patterns in either a counterclockwise or clockwise direction.

In addition, a presently preferred embodiment of my invention is suitable for use with the skimmer face plate disclosed in U.S. Pat. No. 5,285,538 of Frank J. Hodak, hereinafter referred to as the '538 Hodak patent, which is incorporated by reference herein. The '538 Hodak patent discloses a removable face plate for covering a skimmer opening during winter months. The cover element is made from a flexible plastic material which snaps on a specially configured skimmer face plate. The skimmer face plate has a raised or flanged peripheral edge onto which the cover element is snapped. The improved skimmer of the present invention is adapted to be conveniently attached to the peripheral edge of the skimmer face plate of the type disclosed in the '538 Hodak patent.

SUMMARY OF THE INVENTION

Briefly stated, my invention is directed to an improved skimmer for a swimming pool. The skimmer includes a skimmer face place mounted on the sidewall of the pool, having a four-sided, frame-like shape with an opening therein to permit pool water to flow into an interior portion of the skimmer. A weir outwardly extends from the skimmer face plate. The weir has an inner peripheral edge which is secured to at least two sides of the skimmer face plate and comprises an upper leg extending along a top horizontal side of the face plate and a lower leg joined to the upper leg by a corner and extending downwardly along a vertical side of the face plate to a position below a normal water level of the pool. The outer peripheral edges of the upper and lower legs of the weir are spaced outwardly from the face plate an effective distance. The lower leg of the weir thus interferes with the water current flowing past the skimmer and exerts a greater field of influence on the current to direct more surface debris into the skimmer. The inner peripheral edge of the weir preferably carries a flexible lip, such as the lip of the cover element in the aforementioned '538 Hodak patent. The weir may then be easily snapped onto the pre-existing, specially-formed peripheral edge of the skimmer face plate. The detachable weir may be snapped onto the face plate in one of two directions so as to accommodate water flows in either the clockwise or counterclockwise direction. At the close of the swimming season, the weir of the present invention is unsnapped from the face plate and the cover element of the '538 Hodak patent is snapped in place to ready the pool for winterizing.

BRIEF DESCRIPTION OF THE DRAWINGS

Other attributes and advantages of the present invention, in addition to those described above, will become more apparent when reference is made to the attached drawings and the following detailed description, in which.

DETAILED DESCRIPTION OF THE INVENTION

Figure 1:
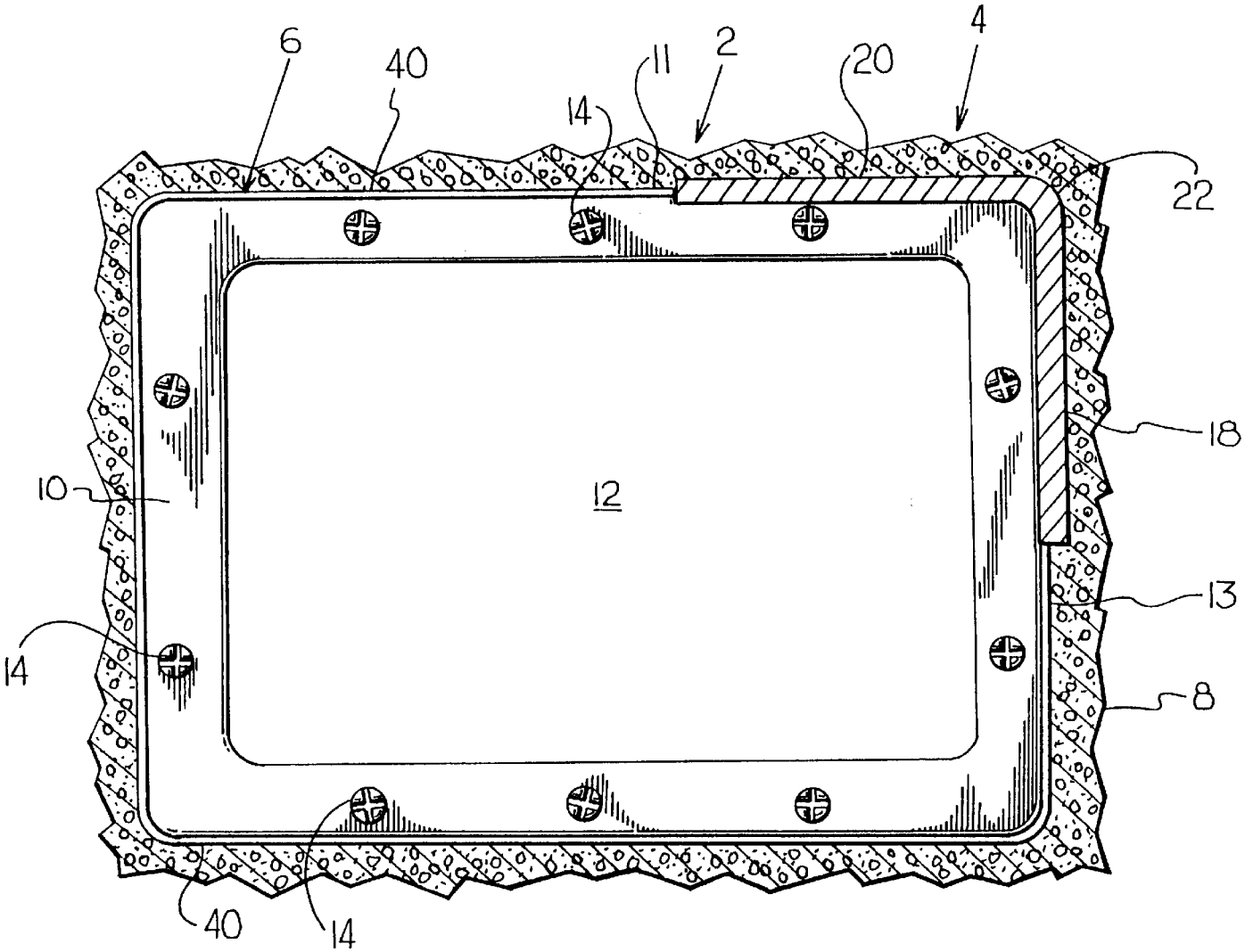
FIG. 1 is a front elevation view of a skimmer face plate with a presently preferred embodiment of the invention attached thereto.

Referring now to the drawings, the skimmer device of the present invention, generally designated by reference numeral 2, comprises a weir 4 extending outwardly from a skimmer face plate 6. As mentioned above, the face plate 6 is preferably the type disclosed in the '538 Hodak patent. The face plate 6 is attached to the sidewall 8 of a swimming pool in a conventional manner using a plurality of screws 14 to secure the face plate to the sidewall and to a skimmer body (not shown) positioned on the outside of the sidewall 8.

Figure 2:
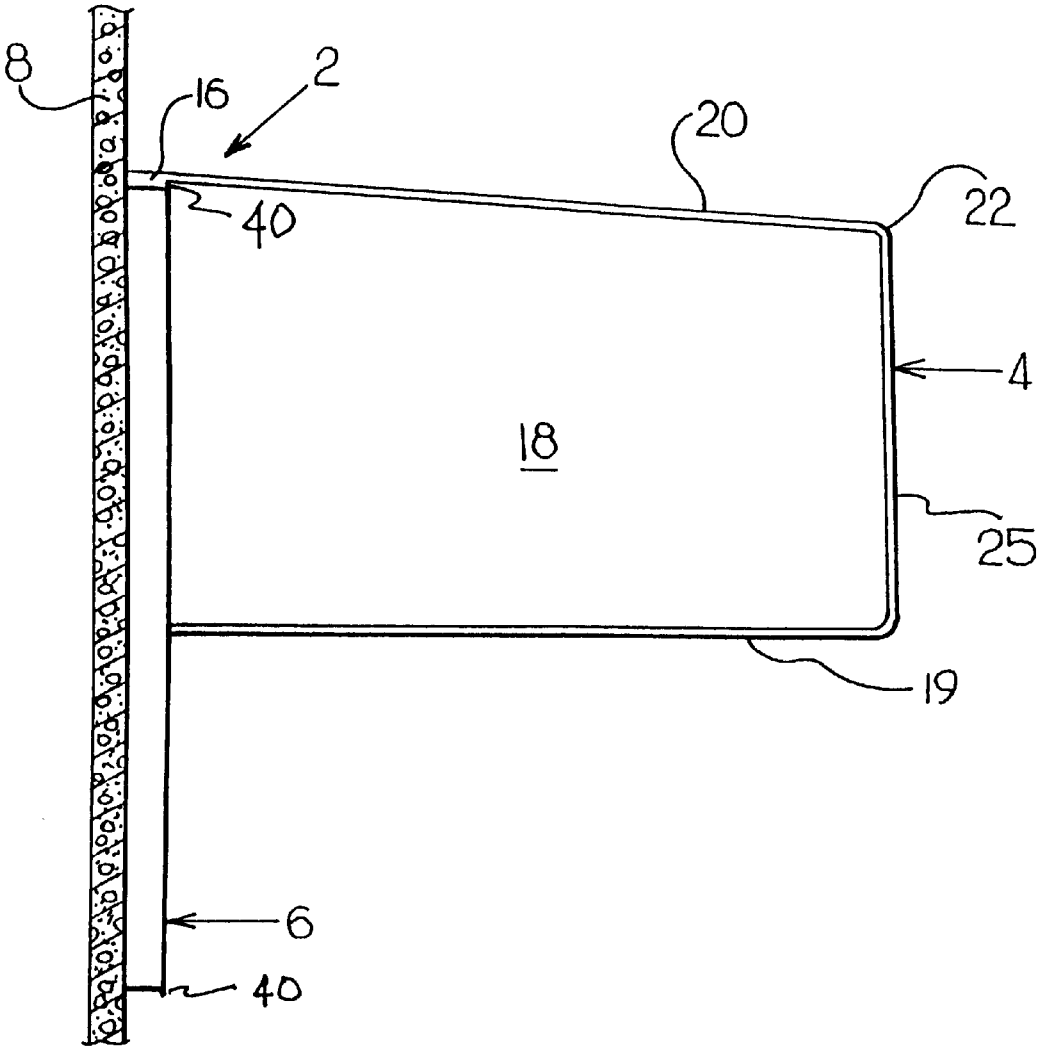
FIG. 2 is a side elevation view of the improved skimmer device of FIG. 1.
Figure 3:
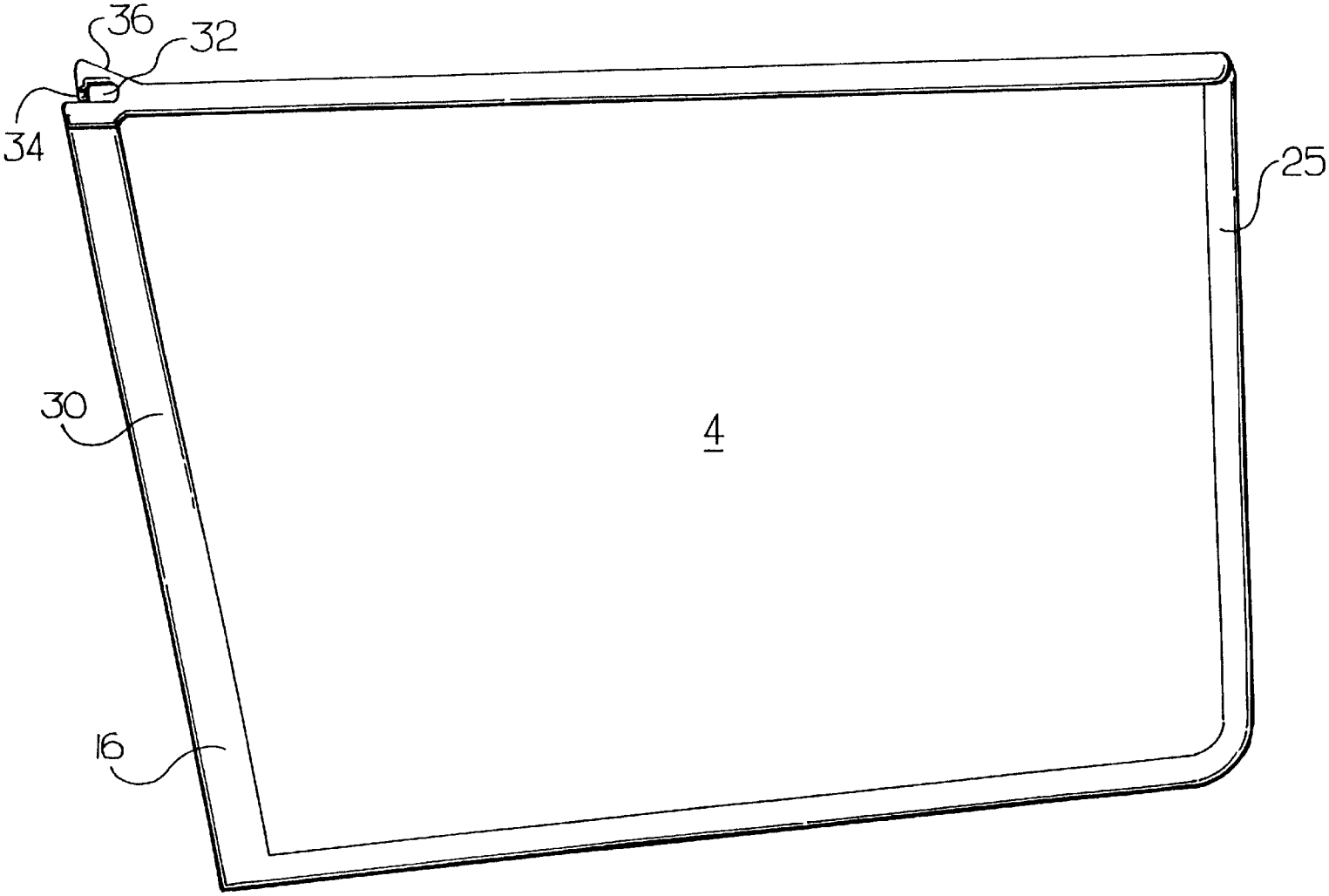
FIG. 3 is a perspective view of a presently preferred weir of the present invention.

One presently preferred embodiment of the weir 4 of my invention is depicted in FIGS. 1–3. The weir 4 has a generally L-shaped configuration including a lower leg 18 and an upper leg 20 joined at a corner portion 22. The weir 4 carries an inner peripheral edge 16 for attachment to the skimmer face plate 6. The inner peripheral edge 16 of the weir 4 is attached to the top side 11 and to one vertical side 13 of the skimmer face plate 6. The two legs 18 and 20 of the weir 4 outwardly extend from the skimmer face plate and terminate at an outer peripheral edge 25. The lower leg 18 terminates at the edge 19 below the water level of the pool. The upper leg 20 of the weir 4 extends outwardly from the top side 11 of the skimmer face plate 6 to meet the outer peripheral edge 25. The lower leg 18 and the upper leg 20 of the weir meet at a corner portion 22.

Figure 4:
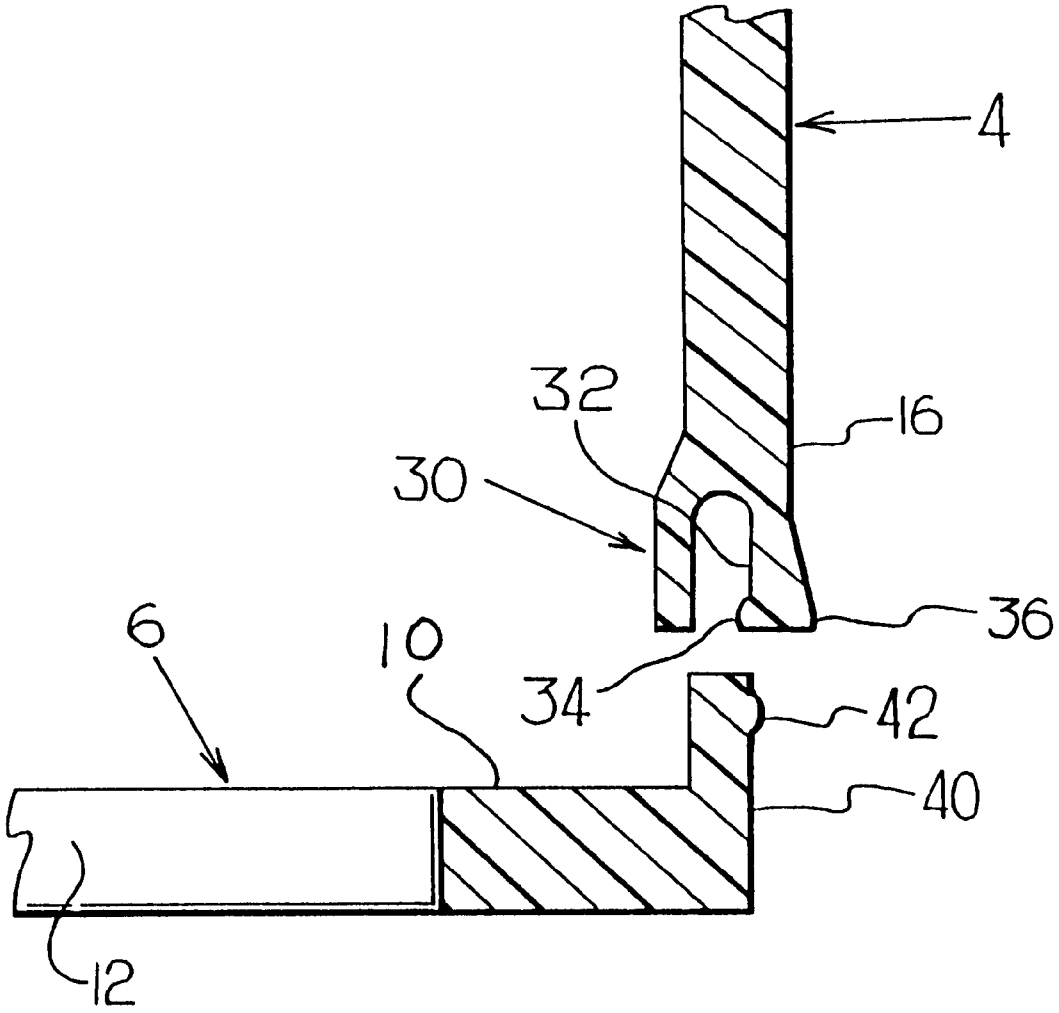
FIG. 4 is an enlarged, cross-sectional view of a skimmer face plate and peripheral attachment edge of the weir of FIG. 3.

The inner peripheral edge 16 of the weir 4 carries a flexible lip 30. As best seen in FIG. 4, the flexible lip 30 has a hollow cutout portion 32 with a raised bead 34 molded therein. In this regard, the weir 4 is preferably injection molded from a flexible thermoplastic material, such as, for example, polypropylene or nylon. The face plate 6 has an outwardly extending flange 40 around the frame-like border 10, carrying a raised bead 42 thereon as disclosed in the '538 Hodak patent. The flexible attachment lip 30 of the weir 4 is adapted to snap onto the flange 40 of the face plate. The parts remain lockably secured together by virtue of the flexible plastic material and the locking action provided by the raised beads 34 and 42 of the mating parts. The lip 30 of the attachment edge 16 of the weir 4 may also contain a flared end 36, as shown in FIG. 4, to provide a gripping portion for easier unsnapping of the flexible lip 30 when the weir 4 is to be removed from the skimmer face plate 6.

Figure 5:
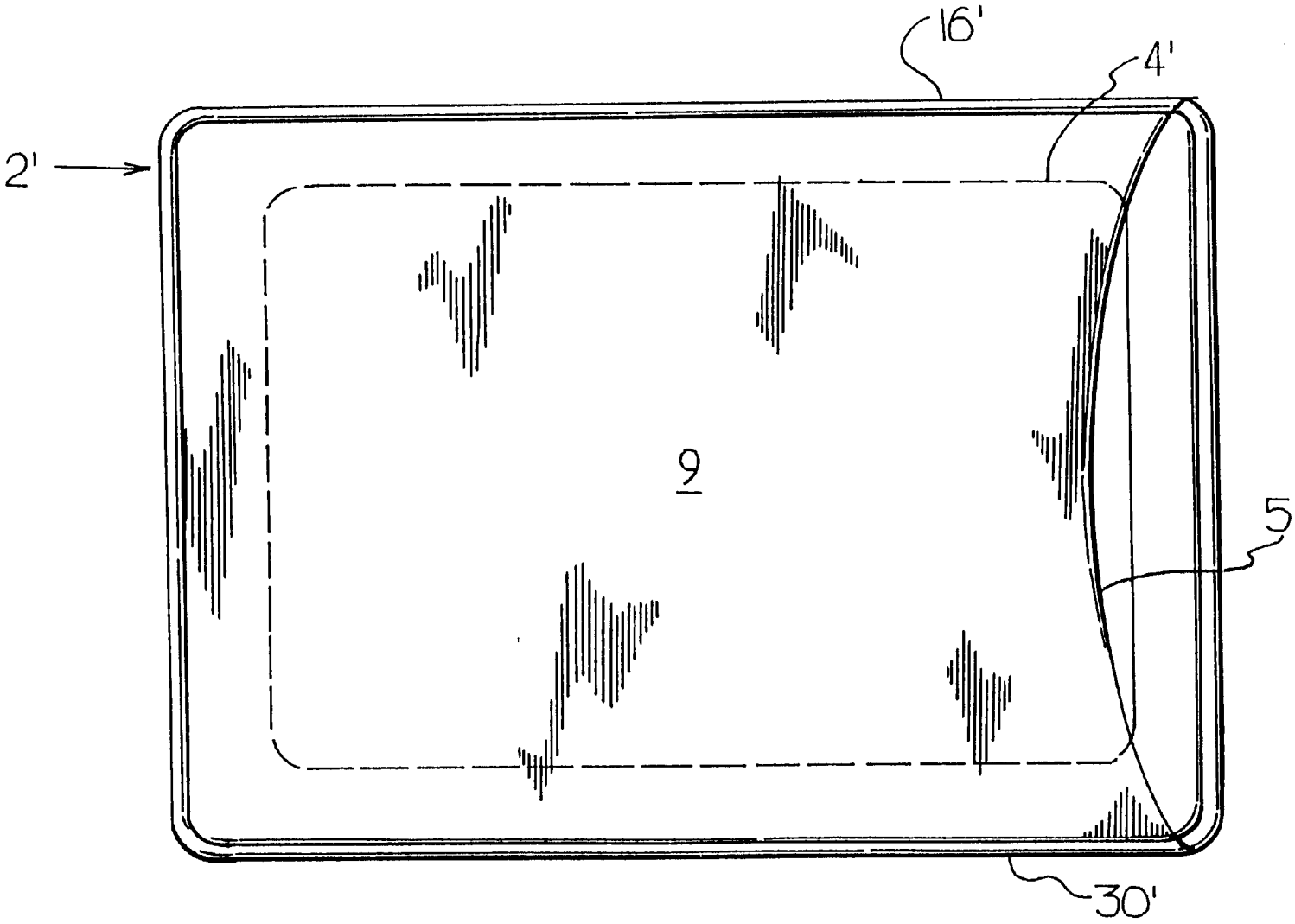
FIG. 5 is a front elevation view of a further embodiment of the weir of the present invention.

A further embodiment of the present invention 2 is shown in FIG. 5 wherein the invention 2' is in the form of a weir 4'. The weir 4' has a scoop-like cover element 9 which encloses the face plate 6 on three sides; namely, top, bottom and one side edge thereof and includes a flexible lip 30' along an attachment edge 16' to provide securement to the face plate 6 in the manner described above. The open end 5 of the weir 4' extends outwardly away from the face plate a distance of about four inches to eight inches to increase the skimming efficiency of the skimmer device.

The injection molded, flexible plastic material, such as polyethylene, makes the weir 4 or 4' practically unbreakable, while providing a safe product for swimmers in that it will bend without injuring anyone who may inadvertently come in contact with the weir 4 or 4'.

In use, the weir 4 or 4' is snapped onto the flange 40 of the skimmer face plate 6. The outer peripheral edge 25 of the lower leg 18 of the weir depicted in FIGS. 1 and 2 comes in contact with and interrupts the current of the water flowing past the skimmer opening 12. This interruption of the current flow creates a stronger field of influence in the oncoming path of existing water currents created by the pool's pump since the natural water flow is obstructed. A whirlpool-like action is created by the weir to cause more of a swirling effect in the pool causing material in the inner portion of the pool to reach the skimmer in far less time than is experienced with a conventional flat skimmer device. The weir 4 of the present invention is universal and is adapted to be fitted on either side of the skimmer face plate 6 to accommodate water current flow in either direction. As stated, the weir 4 features easy installation, flexibility and, thus, safety, and is fully reversible to face left or right, depending upon the pool's current or flow path. The weir 4 is cosmetically trim and economical to manufacture, requiring no special skill to install.

The leading edge 25 of the weir can be made to extend outwardly from the face plate any reasonable distance within the spirit of the present invention. Typically, the outer edge could extend outwardly six inches to ten inches or more from the pool sidewall. For appearance purposes and for a balance between appearance and performance, I prefer to keep the spacing at a maximum of about eight inches from the surface of the face plate 6. A spacing as little as three inches is effective, however.

While specific embodiments of the invention have been described in detail, it will be appreciated by those skilled in the art that various modifications and alternatives to those details could be developed in light of the overall teachings of the disclosure. For example, the weir 4 could be made integral with the face plate rather than being detachable. The presently preferred embodiments described herein are meant to be illustrative only and not limiting as to the scope of the invention which is to be given the full breadth of the appended claims and any and all equivalents thereof.

Have described the invention, what is claimed is:

1. A skimmer for a swimming pool comprising, in combination, a skimmer face plate and a detachable weir, said skimmer face plate adapted for mounting on a pool sidewall, said face plate comprising a four-sided frame shaped border surrounding an opening to permit pool water to flow therethrough, said four-sided border having flange means formed around a periphery thereof, extending outwardly from the face plate; and wherein said detachable weir is made from a flexible plastic material and having a flexible lip means formed along a peripheral edge of said weir for snappable attachment to the flange means of the skimmer face plate along at least two sides of said four-sided frame shaped border, said weir being shaped to extend along a surface of the water when attached to the flange means of the skimmer face plate to divert a portion of the pool water flowing past the skimmer into said skimmer opening, and wherein said weir is adapted to be detachably removable from the face plate and rotated 180° for reattachment on the flange means on an opposite side of said face plate to accommodate a reverse current of water flowing in the pool.

2. The skimmer of claim 1 wherein the weir has two sides joined at a corner, extending outwardly from said flexible lip means for attachment to said flange means along a top perimeter edge and along a side perimeter edge of said four-sided frame shaped border of the skimmer face plate.

3. The skimmer of claim 1 wherein the weir is rectangularly shaped having a scoop-shaped cover extending outwardly from a top edge and a bottom edge and a first side edge, wherein an opposed, second side edge has an opening therein and wherein said top, bottom and first side edges carry said flexible lip means, whereby, in use, pool water is diverted into the opening in said open second side edge of the weir.

* * * * *